US005899087A

United States Patent [19]

Lee

[11] Patent Number: 5,899,087

[45] Date of Patent: May 4, 1999

[54] DRYER FIXING DEVICE FOR USE IN A COOLING APPLIANCE

[75] Inventor: Yong-Keon Lee, Incheon, Rep. of Korea

[73] Assignee: Daewoo Electronics Co., Ltd., Seoul, Rep. of Korea

[21] Appl. No.: 08/941,918

[22] Filed: Oct. 1, 1997

[30] Foreign Application Priority Data

Oct. 21, 1996 [KR] Rep. of Korea ..... 96-47265

[51] Int. Cl.[6] ..... F25B 43/00

[52] U.S. Cl. ..... 62/298; 62/474; 248/229.16; 248/316.7

[58] Field of Search ..... 62/298, 474; 248/229.16, 248/229.26, 300, 316.7

[56] References Cited

U.S. PATENT DOCUMENTS 3,216,685 11/1965 Raymond ..... 248/316.7
3,295,812 1/1967 Schneider et al. ..... 248/229.16
3,550,887 12/1970 Kwiatkowski ..... 248/300
4,611,722 9/1986 Teig ..... 248/229.26
5,364,051 11/1994 Philpot ..... 248/300

*Primary Examiner*—William E. Tapolcai
*Attorney, Agent, or Firm*—Smith, Gambrell & Russell, Beveridge, DeGrandi, Weilacher & Young

[57] ABSTRACT

A device for use in a cooling appliance for fixing a dryer on a condenser having a plurality of pipe parts. The fixing device comprises a plate-shaped body, a supporting part formed at one end of the body and inserted between the pipe parts to elastically support the body, a fixing part formed at the other end of the body and accommodating one pipe part of the condenser to fix the body, and a circular-shaped holder part for elastically fixing the dryer. The fixing device is fixed at the condenser by inserting the supporting part between the pipe parts and pushing the fixing part to other pipe part, and the dryer is fixed at the fixing device by inserting the dryer in the holder part. Thus the dryer is fixed in a simple manner.

4 Claims, 4 Drawing Sheets

DRYER FIXING DEVICE FOR USE IN A COOLING APPLIANCE

BACKGROUND OF THE INVENTION

1. Field of the Invention

The present invention relates to a dryer fixing device, and more particularly to a device for fixing a dryer for use in a cooling appliance such as a refrigerator, an air conditioner, and the like, in which the dryer is fixed on a condenser having a plurality of pipe parts disposed in parallel with each other.

2. Prior Art

Generally, the cooling appliance such as a refrigerator or an air conditioner has a compressor for compressing refrigerant, a condenser for radiating heat from the compressed refrigerant, and an evaporator for generating cool air by evaporating the refrigerant. The refrigerant which circulates in the compressor, the condenser, and the evaporator contains a lot of impurities such as humidity, dirt, metal, oil, etc. Such impurities circulate together with the refrigerant, and freeze inside a pipe at the area where the temperature is abruptly lowered, whereby the flow of the refrigerant is interrupted. Thus, the cooling efficiency of the cooling appliance is lowered by such impurities. In particular, when there is a variation of the refrigerant which has become low in temperature and high in pressure by the condenser to the refrigerant of low temperature and low pressure by a capillary tube, if the impurities cannot pass through the capillary tube because of the frozen impurities or because of the large size of the impurities, the refrigerant cannot circulate and then the cooling operation stops. To prevent such a phenomenon, the cooling appliance is equipped with a dryer for filtering the impurities in the refrigerant between the condenser and the capillary tube.

The dryer performing such a function is fixed at a side part of the condenser by a fixing device. FIG. 1A and FIG. 1B are a perspective view of a fixed state of a dryer by a conventional dryer fixing device. The condenser 10 consists of a pipe 11 wound to have a shape of a coil, and brackets 12 combined at both ends of the pipe 11. The dryer 14 is fixed at one of the brackets 12. The pipe 11 of the condenser 10 is connected at one side of the dryer 14, and the capillary tube which is not shown is connected to the other side thereof.

The dryer 14 is fixed to the condenser 10 by a fixing device. Conventionally, as shown in FIG. 1B, a band 15 is generally used for the fixing device. The band is formed with a ring 16 at one end thereof which has a stopper 17 protruded therefrom, and a plurality of holes 18 for controlling a banding degree are formed at the other end part thereof. The bracket 12 of the condenser 10 and the dryer 14 are wound altogether by the band 15, and then the end part which is formed with the holes 18 is inserted into the ring 16. In such a state, if the end of the band 15 which has been inserted into the ring 16 is pulled, the band 15 tightens the dryer 14 to the bracket 12. Then, the stopper 17 is inserted into the hole 18 formed at one end part of the band 15, whereby the band 15 is maintained tight and the dryer 14 is fixed on the condenser 10.

However, such a conventional dryer fixing device has a problem that the fixing procedure is not easy since the processes for fixing the dryer 14 comprise many steps. That is, in order to fix the dryer 14, the user contacts the dryer 14 with the condenser 10 and winds the band 15 at first, then the user should insert the end of the band 15 into the ring 16 and pull it. Thus, the process for fixing is complex and time-consuming.

Furthermore, if the dryer 14 fixed on the condenser 10 needs to be amended or replaced with a new one, since the stopper 17 is not withdrawn easily from the hole 18, it is hard to untie the band 15, so the band 15 should be cut to release the dryer 14 from the condenser 10. Therefore, the band 15 cannot be re-used, and it should be replaced with a new one.

SUMMARY OF THE INVENTION

The present invention has been proposed to overcome the above described problems in the prior art, and accordingly it is an object of the present invention to provide a dryer fixing device for use in a cooling appliance, with which it is possible to fix the dryer on the condenser in a short time, and releasing the dryer from the condenser in order to amend it or replace it with a new one can be performed easily.

To achieve the above object, the present invention provides a device for fixing a dryer on a condenser for use in a cooling appliance, said condenser having a plurality of pipe parts disposed in parallel with each other, said device comprising: a body having a shape of a plate; a supporting part having a tilt-bending part being extended from one end of said body and being bent to be tilted against an assembling direction thereof with said condenser, and a parallel-bending part being extended from said tilt-bending part and being bent to an outer side of said body to be parallel with said body, said supporting part for elastically supporting said body when being inserted between said pipe parts of said condenser; a fixing part having a vertical-bending part being extended from an other end of said body and being bent to the assembling direction thereof with said condenser at a substantially vertical direction against said body, and inward-bending part being extended from said vertical-bending part and being bent to an inner side of said body to be parallel with said body, said fixing part for fixing said body to said condenser by accommodating one pipe part of said condenser therein at the elastically supported state of said body by said supporting part; a guide-bending part being extended from said inward-bending part and being bent to an outer side of said body to be tilted against the assembling direction thereof with said condenser, said guide-bending part for guiding said one pipe part of said condenser into said fixing part when said body moves to the assembling direction with said condenser; and a holder part being extended from said body and being curved to have a circular shape, said holder part for accommodating said dryer therein to elastically fix said dryer therein when fixing said body to said condenser.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Hereinafter, the present invention will be described in detail with reference to the drawings.

Figure 1A:
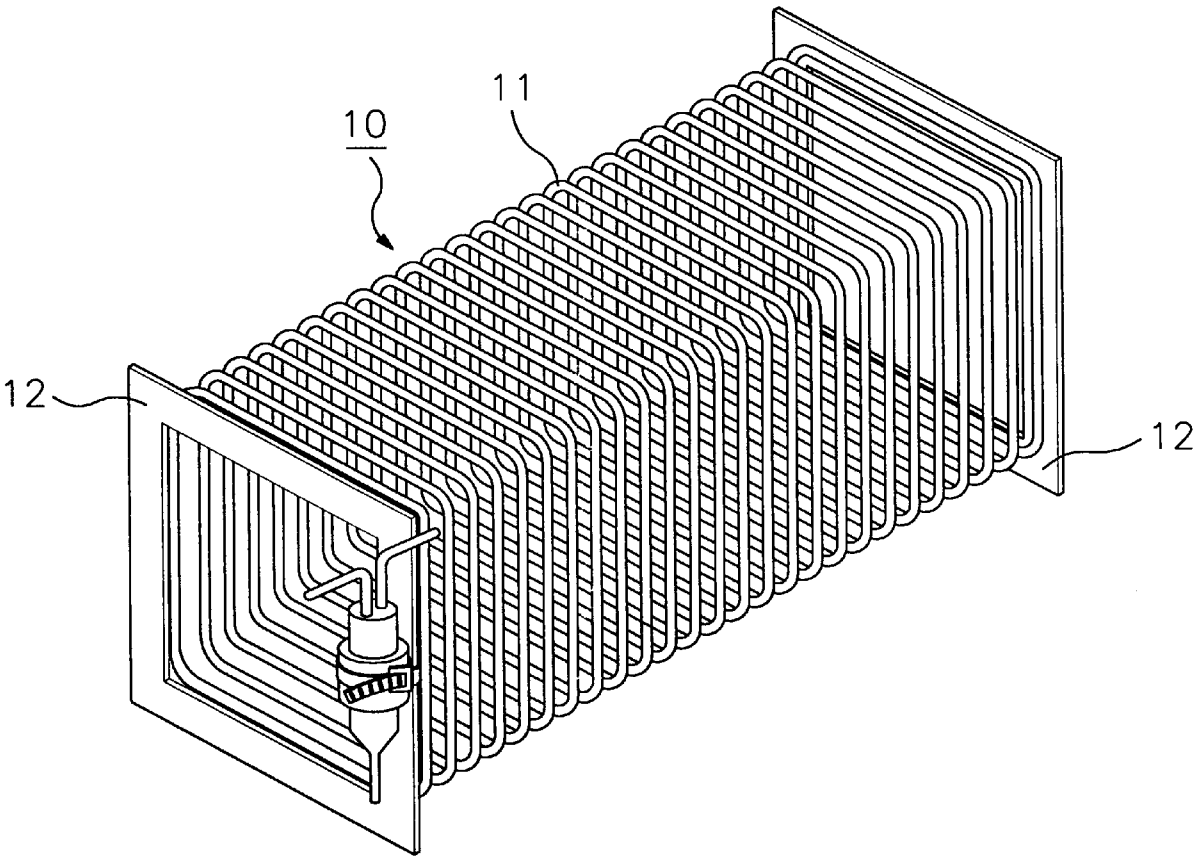
FIG. 1A PRIOR ART
FIG. 1A is a perspective view of a fixed state of a dryer by a conventional dryer fixing device.
Figure 1B:
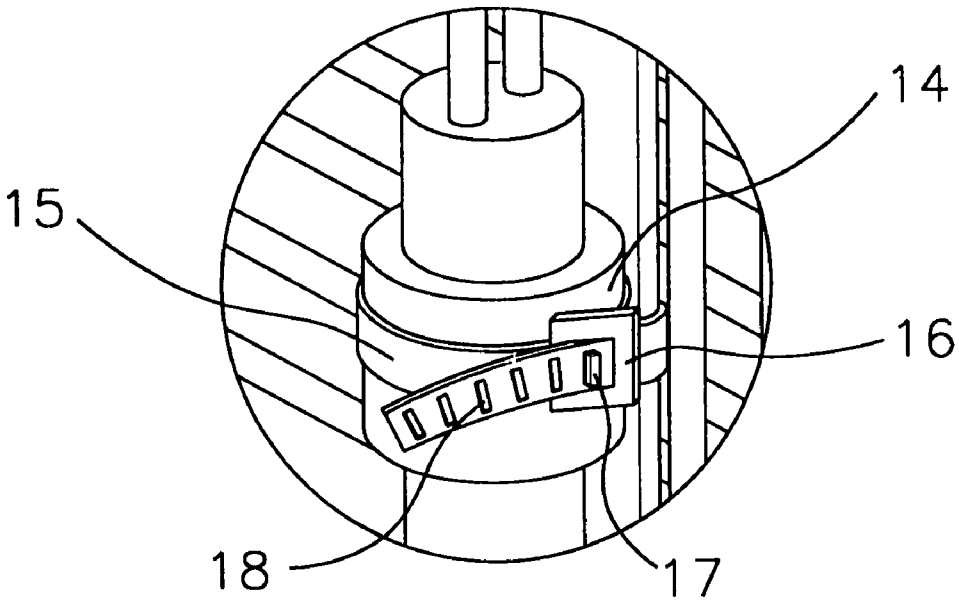
FIG. 1B PRIOR ART
FIG. 1B is an enlarged view of a portion of the dryer in FIG. 1A.
Figure 2:
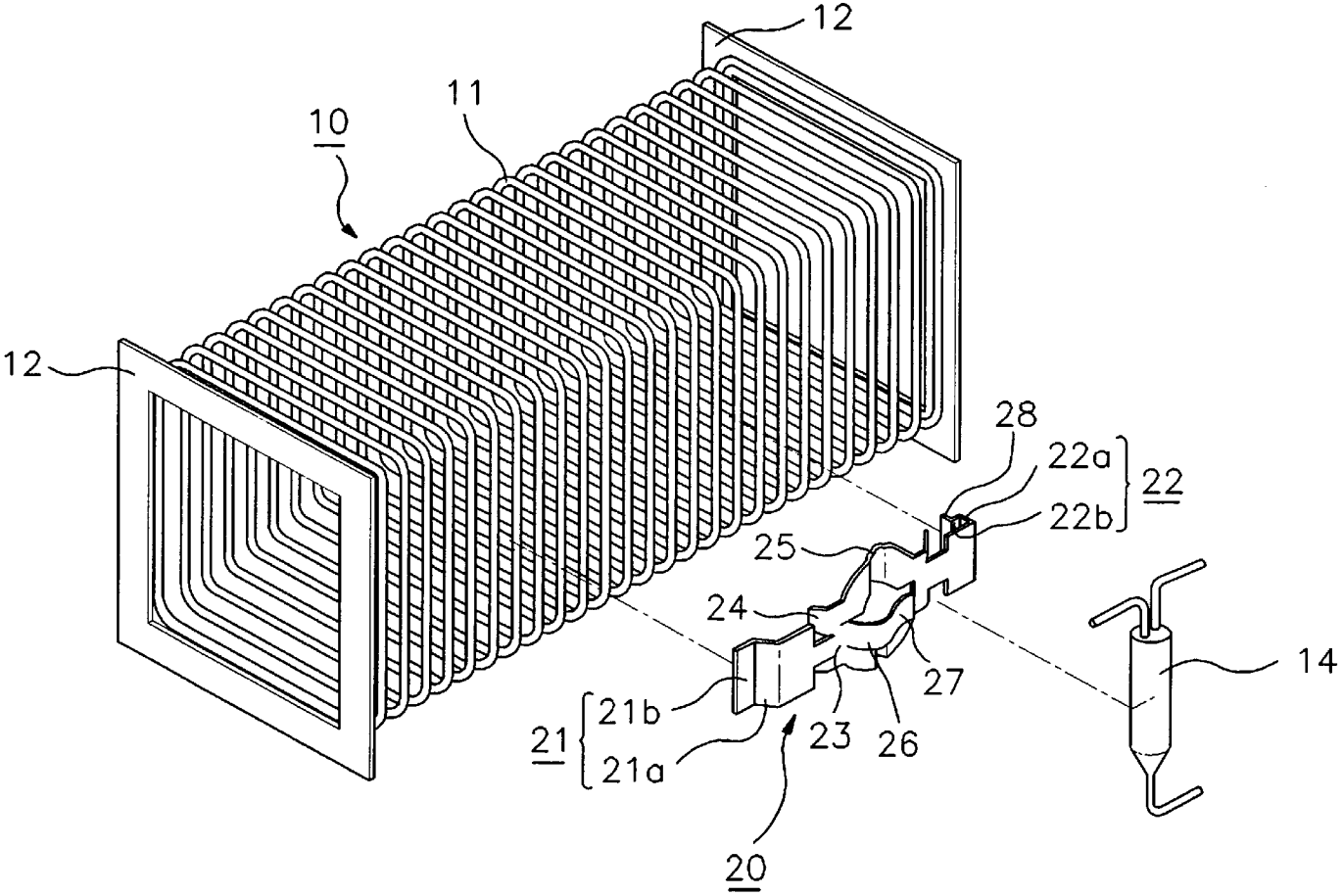
FIG. 2 is a perspective view of a dryer fixing device according to the present invention.
Figure 3:
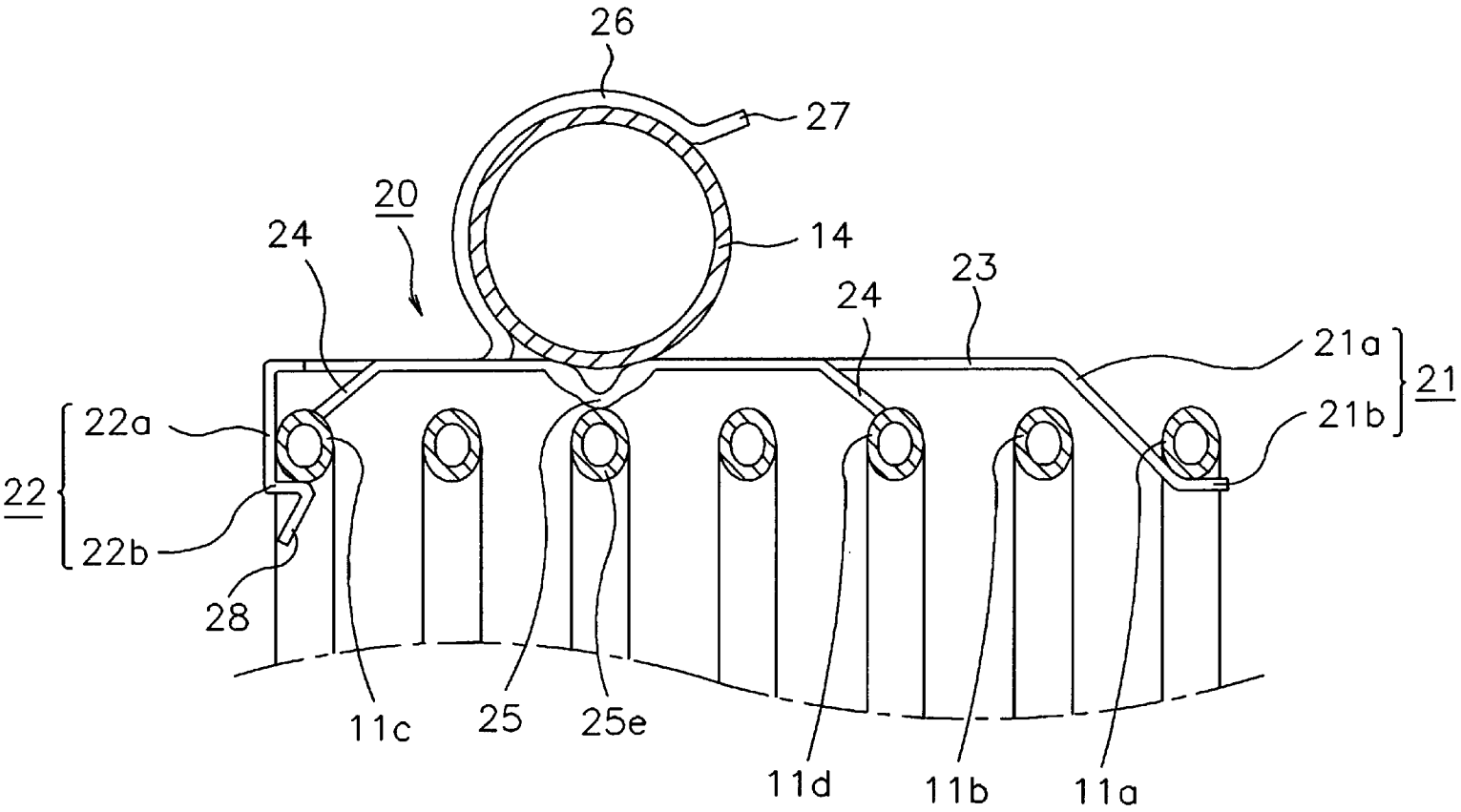
FIG. 3 is a transverse cross sectional view of the assembled state of FIG. 2.

FIG. 2 is a perspective view of a dryer fixing device according to the present invention, and FIG. 3 is a transverse cross sectional view of the assembled state of FIG. 2. The respective parts of the dryer and the condenser will be described with the same reference numerals with the numerals in the conventional art illustrated in FIG. 1.

The condenser 10 consists of a pipe 11 wound to have a shape of a coil, and brackets 12 combined at both ends of the pipe 11. The dryer 14 is fixed at the pipe 11 of the condenser 10 by a fixing device 20.

The fixing device 20 comprises a body 23 having a shape of a plate, a supporting part 21 for elastically supporting the body 23 at one pipe part 11a of the pipe 11, a fixing part 22 for fixing the body 23 to other pipe part 11*c*, and a holder part 26 for fixing the dryer 14 at the body 23.

The supporting part 21 consists of a tilt-bending part 21*a* and a parallel-bending part 21*b*. The tilt-bending part 21*a* is extended from one end of the body 23 and bent to be tilted against an assembling direction thereof with the condenser 10. The parallel-bending part 21*b* is extended from the tilt-bending part 21*a* and bent to an outer side of the body 23 to be parallel with the body 23. The supporting part 21 supports the body 23 elastically when being inserted between the pipe parts 11*a*, 11*b* of the condenser 10.

The fixing part 22 consists of a vertical-bending part 22*a* and an inward-bending part 22*b*. The vertical-bending part 22*a* is extended from the other end of the body 23 and bent to the assembling direction thereof with the condenser 10 at a substantially vertical direction against the body 23. The inward-bending part is extended from the vertical-bending part 22*a* and bent to an inner side of the body 23 to be parallel with the body 23. The fixing part 22 fixes the body 23 to the condenser 10 by accommodating one pipe part 11*c* of the condenser therein at the elastically supported state of the body 23 by the supporting part 21.

A guide-bending part 28 which is extended from the inward-bending part 22*b* is formed at the end of the fixing part 22. The guide-bending part 28 is bent to an outer side of the body 23 to be tilted against the assembling direction thereof with the condenser 10. The guide-bending part 28 guides one pipe part 11*c* of the condenser 10 into the fixing part 22 when the body 23 moves to the assembling direction with the condenser 10.

The holder part 26 is extended from the body 23 and curved to have a circular shape. The holder part 26 accommodates the dryer 14 therein to elastically fix the dryer 14 therein when fixing the body 23 to the condenser 10. A dryer guide part 27 is extended from an end of the holder part 26. The dryer guide part 27 is bent to an outer side of the holder part 26 and guides the dryer 14 into the holder part 26 when the dryer 14 is assembled with the holder part 26.

A plurality of pushing pieces 24 are extended from the body 23. The pushing pieces 24 push elastically toward the pipe parts 11*c*, 11*d* of the condenser 10 when the body 23 is assembled with the condenser 10. Also, a protruding part 25 is formed at the body 23. The protruding part 25 protrudes at a rear side of a side which is formed with the holder part 26. The protruding part 25 pushes elastically toward a pipe part 11*e* of the condenser 10 when the body 23 is assembled with the condenser 10.

Hereinbelow, the process of fixing the dryer 14 by using the dryer fixing device 20 according to the present invention will be described.

At first, the fixing device 20 is located at a side of the condenser 10, and then the supporting part 21 of the fixing device 20 is inserted between the pipe parts 11*a*, 11*b* of the condenser 10, and the body 23 is moved to be in contact with the condenser 10. Then, the parallel-bending part 21*b* of the supporting part 21 pushes the pipe part 11*a*, and accordingly the body 23 is supported by the elastically supporting part 21. In such a state, the body 23 is pushed toward the condenser 10, then the tilted side of the guide-bending part 28 comes in contact with the outer periphery of the pipe part 11*c*. If the body is further pushed toward the condenser 10, the guide-bending part 28 and the vertical-bending part 22*b* are bent outwardly by the pipe part 11*c*, and the body 23 contacts more closely with the condenser 10 to accommodate the pipe part 11*c* in the fixing part 22. At the same time when the pipe part 11*c* is accommodated in the fixing part 22, the guide-bending part 28 and the vertical-bending part 22*b* which have been bent return to the original state by their own the elastic forces, so the pipe part 11*c* is fixed in the fixing device 20 and the fixing device 20 is assembled with the condenser 10. In that situation, the pushing pieces 24 formed at the body 23 push the pipe parts 11*c*, 11*d* respectively, and the protruding part 25 pushes one pipe part 11*e*, too. Therefore, the fixing device 20 is fixed at the condenser 10 more steadfastly. If the user wants to disassemble the fixing device 20 with the condenser 10, he exerts the force to the fixing part 22 of the fixing device 20 to bend it outwardly and separate it from the pipe part 11*c*, and then the fixing device 20 is simply disassembled from the condenser 10.

While the fixing device 20 is fixed at the condenser 10, the dryer 14 is inserted between the holder part 26 and the body 23. During the insertion of the dryer 14, the dryer 14 is smoothly guided inside the holder part 26 by the dryer guide part 27, since the tilted side of the dryer guide part 27 comes in contact with the outer surface of the dryer 14. After the dryer 14 is inserted in the holder part 26 by such a manner, as shown in FIG. 3, the dryer 14 is steadfastly fixed at the fixing device 20 by the holder part 26. Further, if the user wants to disassemble the dryer 14 from the fixing device 20, he exerts the force to pull the dryer 14 along the direction of being disassembled from the holder part 26, and then the dryer 14 is simply disassembled from the fixing device 20.

As described above, according to the present invention, by pushing the fixing device 20 toward the condenser 10 and inserting the dryer 14 into the holder part 26 of the fixing device 20, the fixing device 20 and the dryer 14 are steadfastly fixed in a simple manner. Also, the disassembling work for any amendment or replacement of the dryer 20 is performed by one simple operation.

Although the present invention has been described and illustrated in detail, it is clearly understood that the same is by way of illustration and example only and is not to be taken by way of limitation, wherein the spirit and scope of the present invention is limited only by the terms of the appended claims. For example, although the fixing part 22 consists of the vertical-bending part 22*a* and the inward-bending part 22*b* in the embodiment of the present invention, it is possible to implement the entire fixing part 22 with a rounding part which is rounded to be form-fit with the pipe part 11*c*.

What is claimed is:

1. A device for fixing a dryer on a condenser for use in a cooling appliance, said condenser having a plurality of pipe parts disposed in parallel with each other, said device comprising:

a body having a shape of a plate;

a supporting part having a tilt-bending part being extended from one end of said body and being bent to be tilted against an assembling direction thereof with said condenser, and a parallel-bending part being extended from said tilt-bending part and being bent to an outer side of said body to be parallel with said body, said supporting part for elastically supporting said body when being inserted between said pipe parts of said condenser;

a fixing part having a vertical-bending part being extended from an other end of said body and being bent to the assembling direction thereof with said condenser at a substantially vertical direction against said body, and inward-bending part being extended from said vertical-bending part and being bent to an inner side of said body to be parallel with said body, said fixing part for fixing said body to said condenser by accommodating one pipe part of said condenser therein at the elastically supported state of said body by said supporting part;

a guide-bending part being extended from said inward-bending part and being bent to an outer side of said body to be tilted against the assembling direction thereof with said condenser, said guide-bending part for guiding said one pipe part of said condenser into said fixing part when said body moves to the assembling direction with said condenser; and a holder part being extended from said body and being curved to have a circular shape, said holder part for accommodating said dryer therein to elastically fix said dryer therein when fixing said body to said condenser.

2. The device for fixing a dryer as claimed in claim 1, further comprising a pushing piece being extended from said body, said pushing piece for elastically pushing toward a pipe part of said condenser at an assembled state of said body with said condenser.

3. The device for fixing a dryer as claimed in claim 1, further comprising a protruding part being protruded at a rear side of a side which is formed with said holder part, said protruding part for elastically pushing toward a pipe part of said condenser when said body is assembled with said condenser.

4. The device for fixing a dryer as claimed in claim 1, further comprising a dryer guide part being extended from an end of said holder part and being bent to an outer side of said holder part, said dryer guide part for guiding said dryer into said holder part when said dryer is being assembled with said holder part.

* * * * *